US006899259B2

(12) United States Patent
Takeuchi et al.

(10) Patent No.: US 6,899,259 B2
(45) Date of Patent: May 31, 2005

(54) ROLL STAPLE CARTRIDGE

(75) Inventors: Sadayoshi Takeuchi, Tokyo (JP); Atsuyoshi Fujishima, Tokyo (JP); Yoshihiro Kaneko, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/912,708

(22) Filed: Jul. 25, 2001

(65) Prior Publication Data

US 2002/0017546 A1 Feb. 14, 2002

(30) Foreign Application Priority Data

Jul. 26, 2000 (JP) ..... 2000-225231

(51) Int. Cl.[7] ..... B25C 5/02
(52) U.S. Cl. ..... 227/120; 227/131
(58) Field of Search ..... 227/107–139; 206/398, 400, 408, 409

(56) References Cited

U.S. PATENT DOCUMENTS 4,733,777 A * 3/1988 Van Geyte et al. ..... 206/414
4,833,495 A * 5/1989 Ohmura et al. ..... 396/387
5,353,933 A * 10/1994 Takahashi et al. ..... 206/410
5,685,058 A * 11/1997 Givler ..... 227/112
6,039,230 A * 3/2000 Yagi et al. ..... 227/120

FOREIGN PATENT DOCUMENTS

EP 0 475 436 A3 3/1992 ..... B27F/7/38
EP 0 608 756 A1 8/1994 ..... B27F/7/38
EP 0 917 936 A3 5/1999 ..... B27F/7/38

* cited by examiner

*Primary Examiner*—Mickey Yu
*Assistant Examiner*—J. Gregory Pickett
(74) *Attorney, Agent, or Firm*—Chapman and Cutler LLP

(57) ABSTRACT

A staple cartridge which is composed in order to guide a leading end (20*a*) of a replacing roll staple (20) provided with a band (21) to a guide path (12) with pulling out a leading end of the band (21) from a front portion (11) of an operable and closable lid (2) to load the roll staple (20) and with rotating the roll staple (20) in a staple loading room (6) in a state in which the lid (2) is closed. Roll abutment portions (10) are arranged on the inner surface (2*a*) of the staple loading room (6), the roll staple (20) which is located between the roll abutment portions, are rotatably held by them striding an adhesive portion (A) to prevent a contact between the inner surface (2*a*) and an adhesive portion (A) which has an adhesive material.

8 Claims, 11 Drawing Sheets

ROLL STAPLE CARTRIDGE

BACKGROUND OF THE INVENTION

1. Field of the Invention

The present invention relates to a roll staple cartridge on which a roll staple is loaded.

2. Description of the Prior Art

It is well known that a motor operated stapler utilizing a roll staple in which large number of straight staples are joined in side by side and wound in a roll shape. This roll staple is loaded in a staple cartridge. It is generally performed that whole staple cartridge is exchanged when all the staples in a roll have all been consumed, however, in view of a labor and costs for disposal of the waste, a resource saving and prevention of destruction of the environment, a staple cartridge that can be used repeatedly because it is made to be capable of reloading a roll staple into a loading room, has been already proposed.

In the roll staple for this purpose, for example as shown in FIG. 6 to FIG. 8, a trailing end of a belt like binding band 21 is adhered to a leading end portion 20*a* of the roll staple 20 through adhesive tape 23, and a pulling tab portion 22 is mounted on the leading end of the binding band. Herein, the adhering tape 23 is set in order its outer surface 23A to be adhesive, and the leading end portion 20*a* of roll staple 20 is detachably adhered on to the adhesive surface 23A of adhesive tape 23. A width of the adhesive tape 23 and a width w of the binding band 21 are made narrower than the width w20 of the roll staple.

Thus, as shown in FIG. 6 to FIG. 8, this binding band 21 is wound one round around an outer surface of the roll staple 20, a leading end 21*b* of the binding band 21 is detachably adhered onto the adhesive surface 23A of adhesive tape 23. By this adhesion and winding around, the binding band 21 keeps the roll staple 20 bound in a roll shape.

The roll staple 20 which is composed as described above, is loaded onto a cartridge 1 as hereinafter described. Firstly, a lid 2 which is provided on a front surface of the cartridge 1 is opened as shown in FIG. 9, and the roll staple 20 is set in a loading room 6. Herein the roll staple 20 is set in a state in which the tab portion 22 is put in order to be able to pull out from spacing 15 between the lid 2 and a guide wall 14.

Then the lid 2 is shut and the tab portion 22 is pulled out, as a result, the binding band 21 has been partly pulled out. With this pulling out action, the roll staple 20 is gradually rotated in the loading room 6 in a direction which is designated by an arrow as shown in FIG. 10. When the roll staple 20 is rotated in nearly one round, the leading end portion 20*a* of roll staple 20 is come to position of a guide hole 12*a* as shown in FIG. 9. When the binding band 21 is pulled out further, the leading end portion 20*a* of roll staple is led from the guide hole 12*a* into a guide path 12 along a guide table 7 as shown in FIG. 11.

When staples are still remaining at the guide path 12, the leading end portion 20*a* is directed to a trailing end portion of the remaining staples, and by strong pulling action of the tab portion 22, the adhesive tape 23 is peeled off from the leading end portion 20*a* of roll staple, then the binding band 21 is removed with the adhesive tape from the roll staple. As a result, loading of the roll staple 20 has been completed.

The staples which are guided into the guide path 12, are carried one by one toward a punching portion 13 at a front end of the guide path 12 by a sending means 30 being provided with sending claw and so on which are not shown in drawings in detail. The carried staples are formed in U shape one by one and the U shaped staple is punched out by a driver which is not shown in the drawings, at the punching portion 13.

However, because the adhesive surface 23A of adhesive tape 23 is set as the outer surface as shown in FIG. 10, the adhesive surface 23A adheres onto an inner surface 2*a* of the lid 2 or other portions and so on, when the roll staple 20 is rotated as the binding band 21 is pulled out, it causes that a strong force is required to pull out the binding band 21, and there may be cases that loadability of the roll staple is damaged.

For example, when the adhesive tape 23 fixedly adheres onto an inner surface of the loading room 6, a strong pulling out force is required to peel off this adhesion, it may cause a case that the tab portion 22 which is made of paper is broken by the strong force, and the pulling out could not be completed.

Further, when a strong force is required for this pulling out, in many cases the pulling out is usually done with much prepared impetus, because of this, the leading end portion 20*a* of roll staple 20 strongly collides against the guide hole 12*a* or a portion near by an entrance of the guide path 12, the impact of it may cause an alignment of staples made uneven. In such case, there may be that the leading end portion 20*a* of roll staple 20 could not be carried through the guide path to the punching portion 13 which is arranged adjoining to a top end of the guide path 12 because the guide path 12 is narrow.

SUMMARY OF THE INVENTION

The purpose of the invention is to provide a roll staple cartridge in which the binding band can be pulled out with small force.

The present invention has a feature that a roll staple cartridge comprising: a cartridge body having a loading room to load a roll staple which is formed of sheet staple wound in roll shape; and a lid openably and closably arranged at an opening hole which is made to load said roll staple in said cartridge body; wherein said roll staple is bound by a binding band which has narrower width than said roll staple and whose trailing end portion is adhered peelably at the leading end portion of said roll staple and which is wound around said roll staple and adhered peelably at the leading end portion onto an adhesive surface made at an outer surface of the trailing end portion thereof; said cartridge body is provided with a punching out portion from which a staple is punched out, and a guide path through which said staple is carried to said punching out portion; a leading end portion of said binding band is made capable of being pulled out in a state that said lid is closed; and said roll staple is made to be turned in said loading room by pulling out operation of the leading end portion of said binding band, and thereby to be guided so as to guide the leading end portion of said roll staple into said guide path; characterized in that: roll abutment portions are formed in an inner surface of said loading room so as to hold rotatably said roll staple with striding said binding band which are wound around the outer surface of said roll staple to prevent a contact of the adhesive surface of said binding band with the inner surface of said loading room.

DETAILED DESCRIPTION OF THE EMBODIMENT

Hereinafter an embodiment of the roll staple cartridge according to the present invention will be described with reference to drawings. The portions and members which are equal or equivalent to those in prior art are designated with the same symbols and explanation for those parts will be omitted.

FIG. 1 to FIG. 5 show one example of embodiment of staple cartridge according to the present invention.

Figure 6:
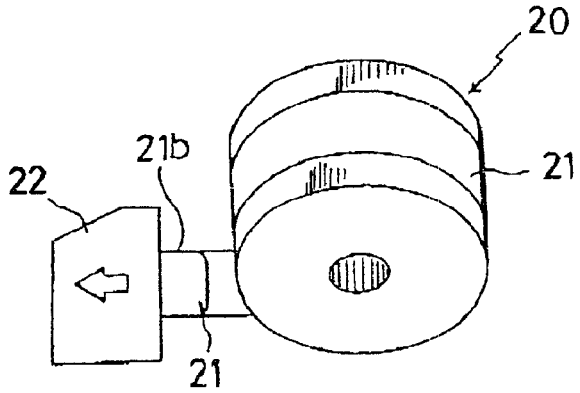
FIG. 6 is a rough sketch of perspective view of a roll staple.
Figure 7:
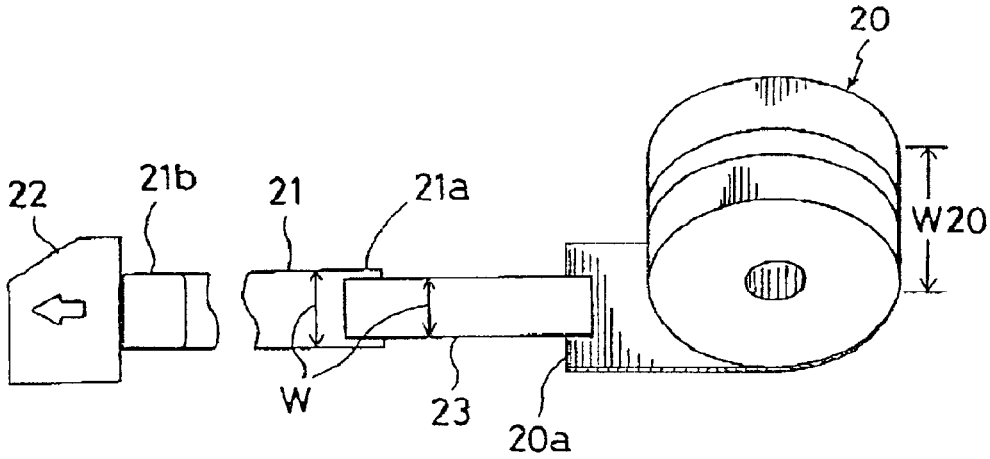
FIG. 7 is a rough sketch of perspective view of the roll staple of FIG. 6 in a state that binding of a binding band is loosed.
Figure 8:
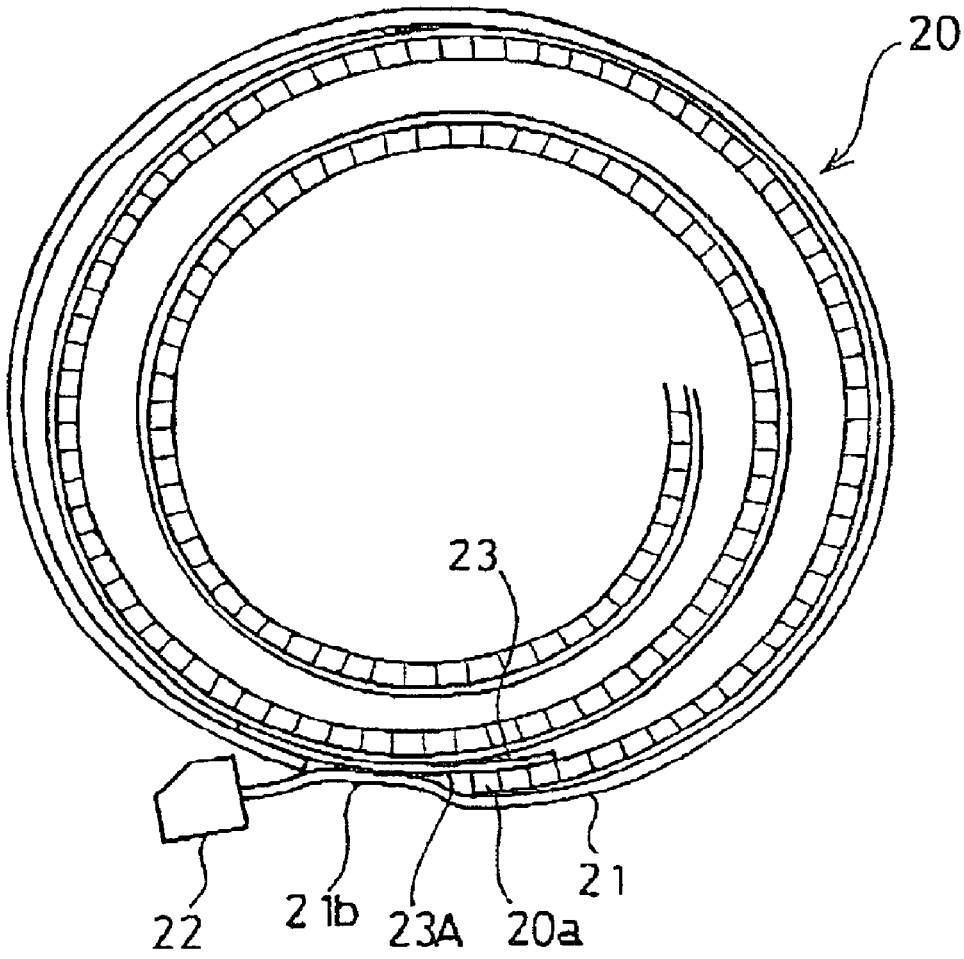
FIG. 8 is an explanatory view showing a state in which a roll staple is bound by a binding band.

This staple cartridge 1 comprises a cartridge body 40 in which a loading room 6 is provided to load a roll staple 20 as shown in FIG. 6, a lid 2 which is openably and closably provided onto the cartridge body 40, a sending means 30 which is provided at a bottom portion of the cartridge body 40 and so on.

The cartridge body 40 comprises a back wall 4 which is formed circularly, a pair of side walls 42, 42 which are formed in one body with the both sides of the back wall 4 and same time arranged to get longer along a direction of a guide path 12 as going downward, another pair of side walls 3, 3 which are formed in one body with inside of the both side walls 42, 42, the front edges 3*a*, 3*a* of them are formed in half circular and protruding frontward from slanted surfaces 42*a*, 42*a* of the side walls 42, 42, a guide table 7 provided in one body at an under portion of the side walls 42, 42 and a guide wall 14 which is provided in front and upper portion of the guide table 7 in one body with and between the side walls 42, 42.

Figure 9:
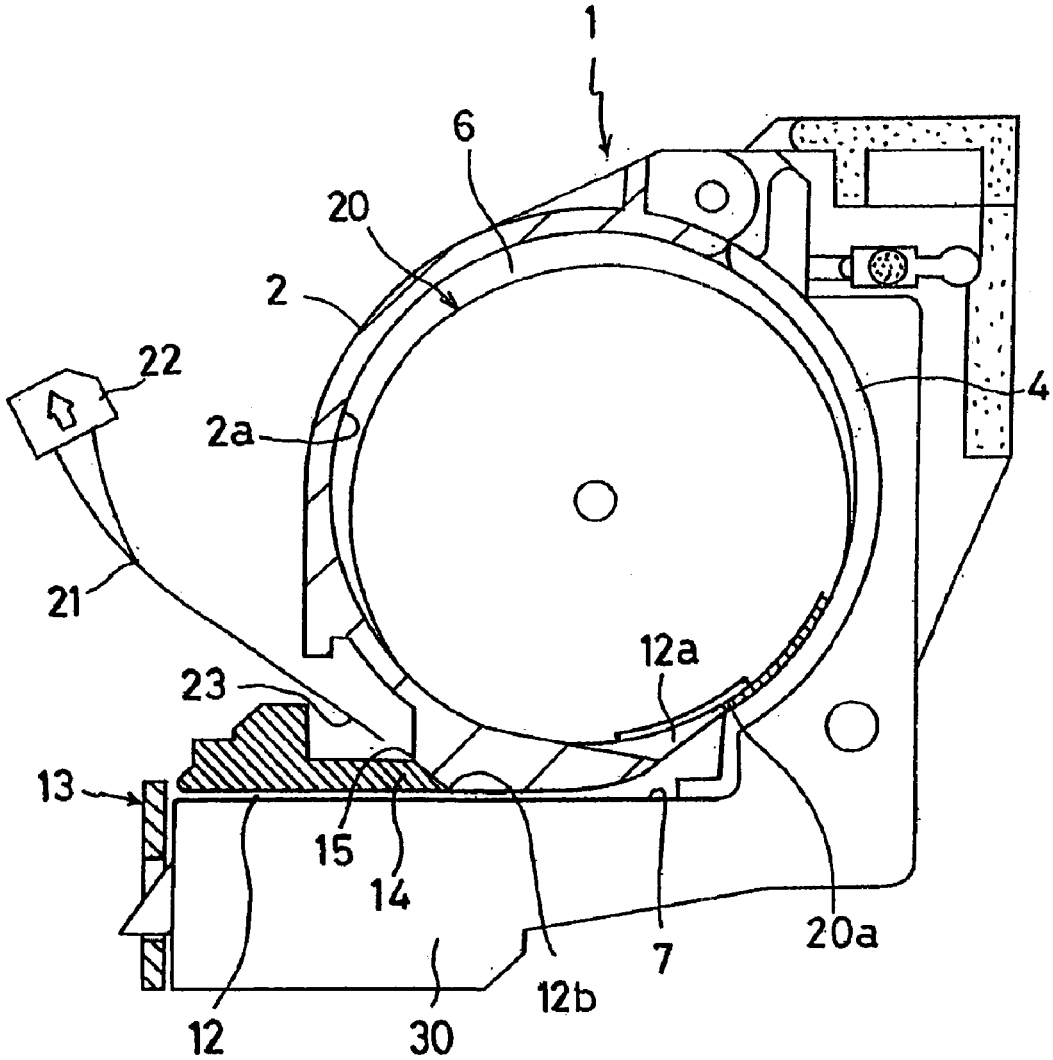
PRIOR ART F I G. 9
FIG. 9 is an explanatory view showing a staple cartridge of prior art.
Figure 10:
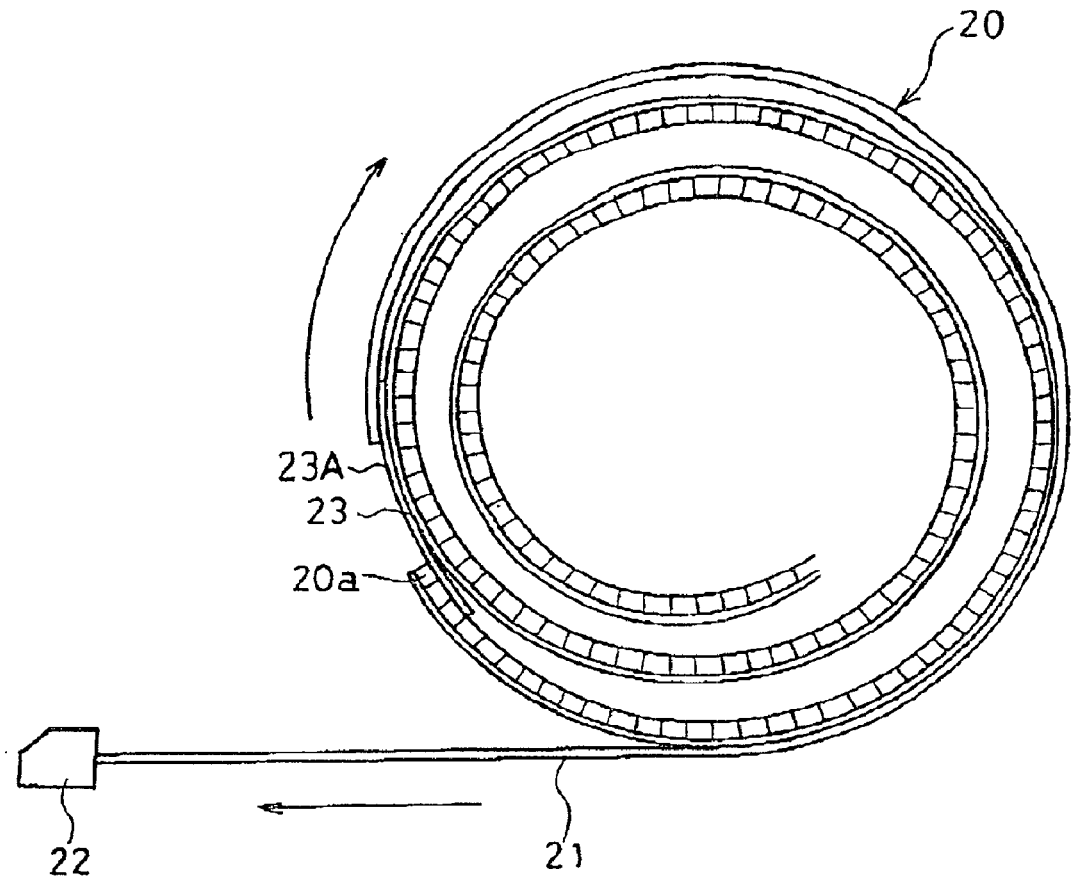
FIG. 10 is an explanatory view showing a state in which a roll staple is made to turn according as the binding band is pulled out.
Figure 11:
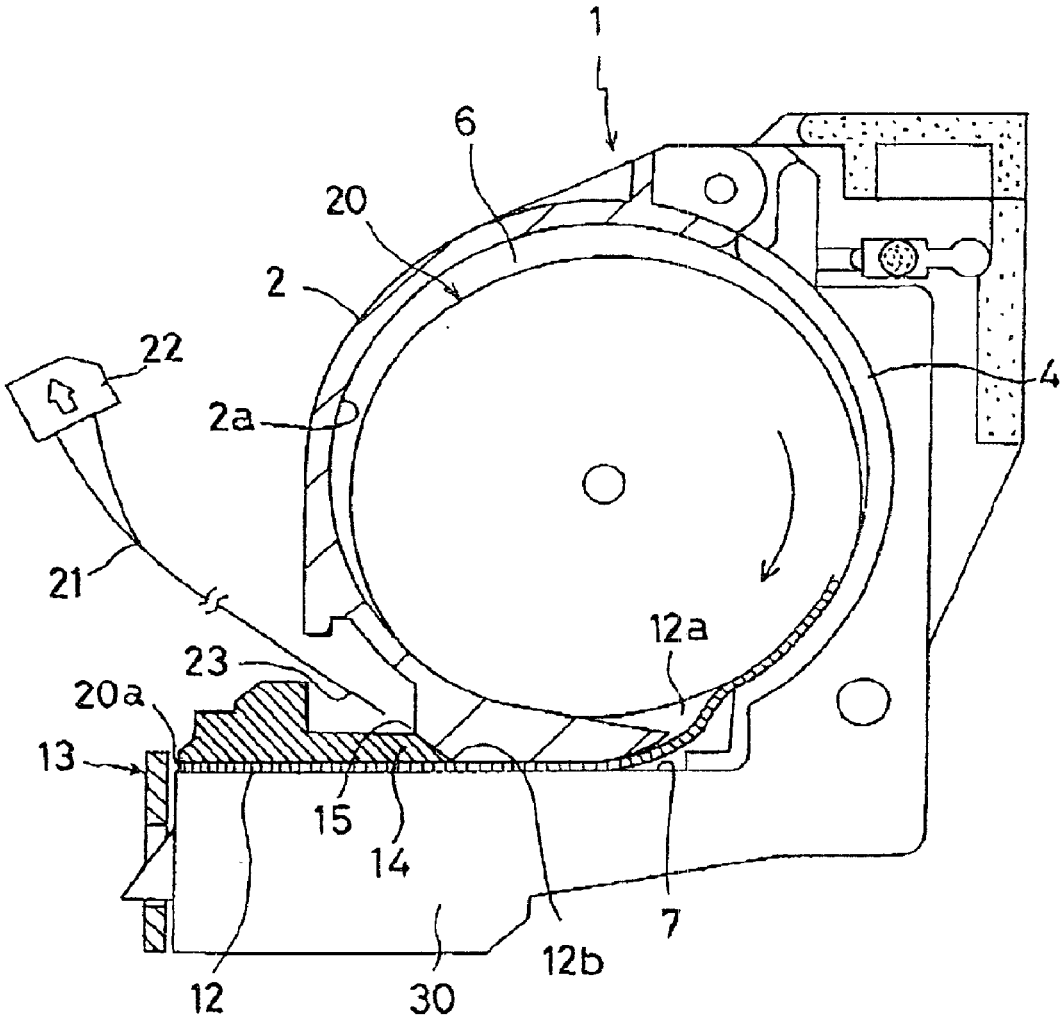
FIG. 11 is an explanatory view showing a state in which a leading end portion of a roll staple is guided to a guide path according as the binding band is pulled out.

And the loading room 6 is formed with the back wall 4, side walls 3, 3, and the guide table 7 and an opening hole 43 to load the roll staple 20 is formed in front side of this loading room 6. The guide path 12 is formed with the guide wall 14 and the guide table 7 to guide the staple. At a front end of this guide path 12, a punching portion 13 (See FIG. 9) is provided to punch out a staple.

Figure 2:
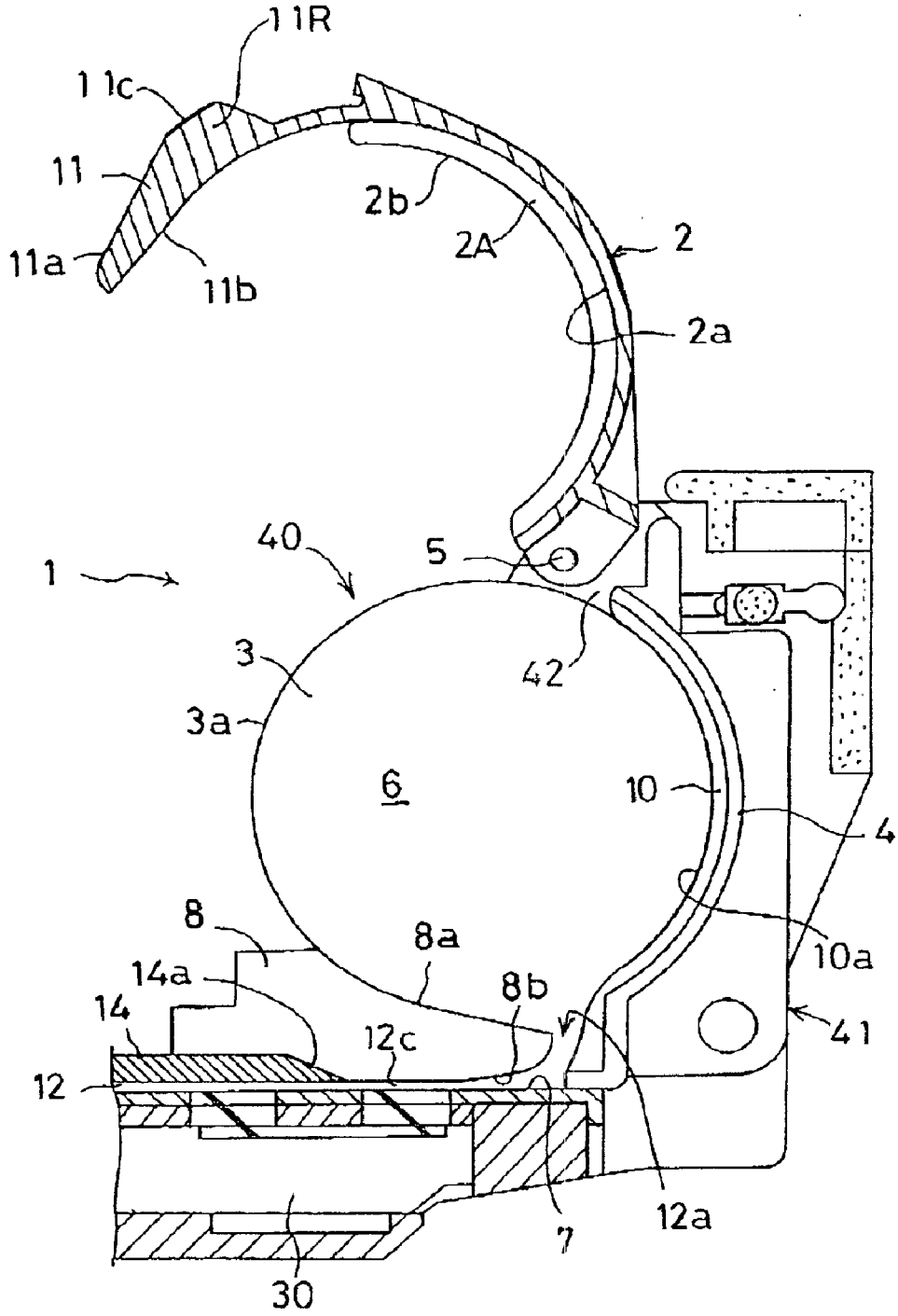
FIG. 2 is a schematic side view of the staple cartridge of FIG. 1 in the state that the lid of it is opened.

At a back portion of the guide wall 14 a slanted surface 14*a* is formed so that it is climbing up toward its front side (left side in FIG. 2). Further, in the both sides of the guide wall 14, a pair of holding portions 8, 8 are arranged which protrudes toward backside. A spacing distance between these holding portions 8, 8 is arranged larger than the width of binding band 21 of the roll staple 20 (See FIG. 6). As shown in FIG. 2, circular holding surfaces 8*a*, 8*a* are formed in upper right portion of these holding portions, 8, 8.

A predetermined spacing is formed between these holding portion 8, 8 and the guide table 7, and this spacing is a guide carrying path 12*b* to guide a staple to the guide path 12. A back portion and an under portion of the holding portions 8, 8 become guide surfaces 8*b*, 8*b* which are gently curved. And a guide hole 12*a* is formed between the back portion of holding portions 8, 8 and under portion of the back wall 4 and the guide hole 12*a* becomes an entrance of a guide carrying path 12*c*.

Moreover in both side end portions of inner surface of the back wall 4, roll abutment portions 10, 10 are formed, which are made of thicker portions with their thickness of about 0.2 mm (the thickness depicted in the drawings is exaggerated, and surfaces of these roll abutment portions 10, 10 are arranged to become circular abutment surfaces 10*a*, 10*a*. A spacing width between the roll abutment portions 10, 10 is set wider than a width of the binding band 21 of roll staple 20. The thickness of roll abutment portion 10 is set in order not for the adhesive tape 23 of roll staple 20 to contact with an inner surface of the back wall 4, and it may be larger than 0.2 mm.

The lid 2 is formed in circular shape, and the back portions of the lid 2 are supported by supporting shafts 5, 5 which are provided on an upper portion of the side walls 42, 42 of cartridge body 40, the lid 2 is arranged in order to open and close the opening hole 43 of cartridge body 40 with a rotation around the supporting shafts 5, 5.

An inner surface of the lid 2 is formed in circular shape, and in both side end portions of the inner surface of the lid 2, roll abutment portions 2A, 2A are formed along an inner surface 2*a*, which are made of thicker portions with their thickness of about 0.2 mm, and surfaces of these roll abutment portions 2A, 2A are arranged to become circular abutment surfaces 2*b*, 2*b*. Again the spacing width between the roll abutment portions 2A, 2A is set wider than the width of the binding band 21 of roll staple 20.

Figure 1:
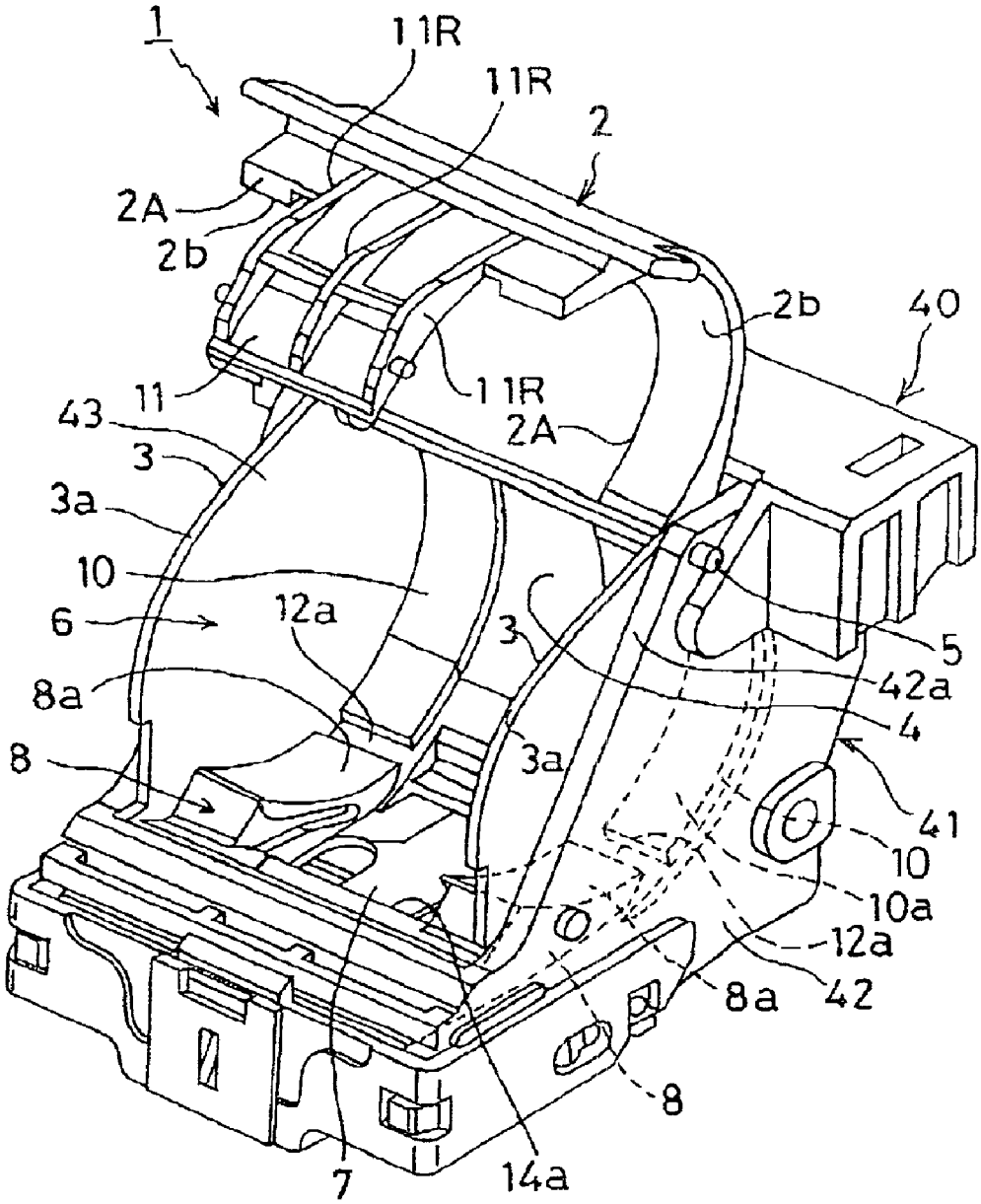
FIG. 1 is a perspective view of a staple cartridge according to the present invention in a state that a lid of it is opened.
Figure 3:
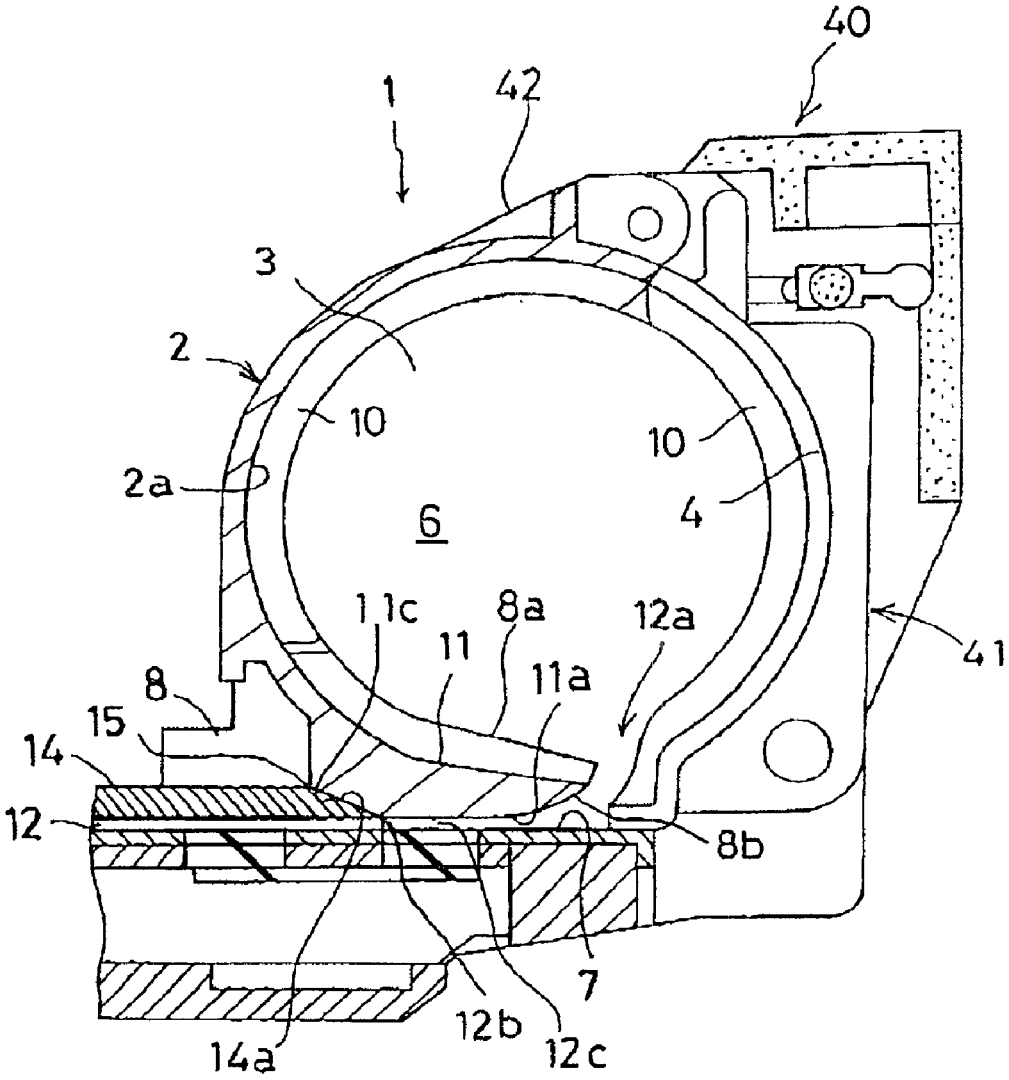
FIG. 3 is a schematic side view of the staple cartridge of FIG. 2 in a state that the lid of it is closed.

In a central portion of front end of the lid 2, a protruding portion 11 which is protruding along a circumferential direction of the lid 2, is formed. As shown in FIG. 1 three ribs 11R which are extending along circumferential direction of the lid 2, are formed in an upper surface of the protruding portion 11. A guide surface 11*a* which has the same shape of the guide surface 8*b* of holding portion 8, and a facing surface 11*c* which is facing to the slanted surface 14*a* of guide wall 14 are formed on the upper portion of respective ribs 11R as shown in FIG. 2. And when the lid 2 is closed as shown in FIG. 3, the protruding portions 11 are inserted between the holding portions 8, 8 of loading room 6, and the guide surface 11*a* of ribs 11R and the guide surface 8*b* of holding portion 8 are matched together, and the facing surface 11*c* of rib 11R is facing to the slanted surface 14*a* of guide wall 14, as a result a spacing 15 which has a predetermined size, is arranged to be formed between the slanted surface 14*a* and the facing surface 11*c*.

An entering hole of the lower portion of this spacing 15 is arranged to adjoin the guide path 12, and the spacing 15 is used as an exit hole in order to pass the binding band 12.

Hereinafter an operation of the staple cartridge 1 which is composed as described above, will be explained.

First, the lid 2 is opened as shown in FIG. 1 and FIG. 2, then the roll staple 20 which is shown in FIG. 6, is loaded in the loading room 6. And the binding band 21 of the roll staple 20 is brought into a state that it is put on the slanted surface 14*a* of the guide wall 14, and at the same time the tab portion 22 is brought into a state that it is pulled out on the guide wall 14, then the lid 2 is closed. As a result of these operations the binding band 21 is pulled out from the guide hole 12*a* through the guide carrying path 12*c* to the spacing 15, and it is brought into a state that the binding band 21 is pulled out from the spacing 15.

In this state the leading end of binding band 21 is peeled off from the adhesive surface 23A of the adhesive tape 23, and the adhesive surface 23A is exposed and located between the holding portions 8 and 8, or between the roll abutment portions 2A and 2A.

Figure 5:
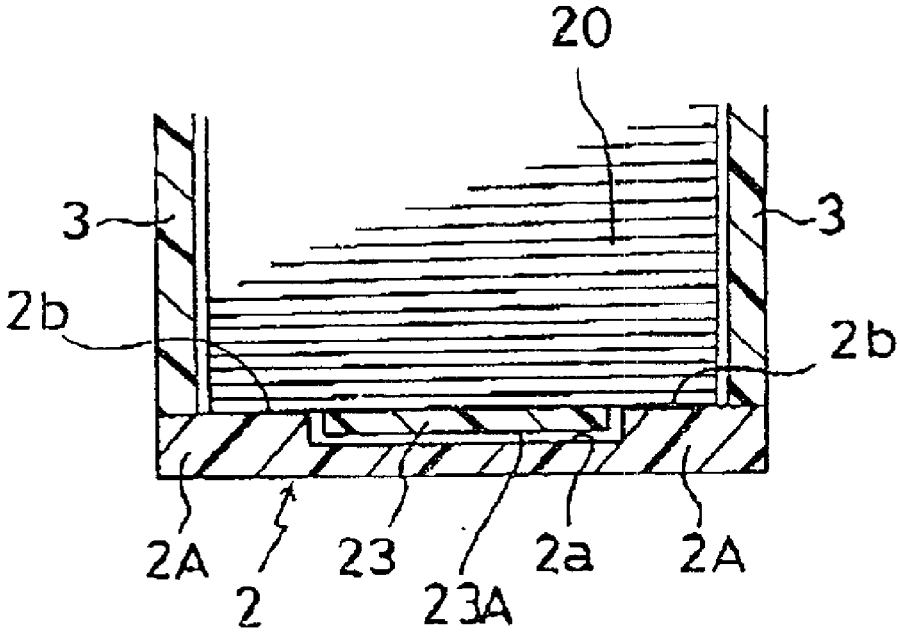
FIG. 5 is a partial cross sectional view of the staple cartridge of FIG. 4 when it is cut along the line X—X.

On the other hand the roll abutment surfaces 10*a*, 10*a* of the roll abutment portions 10, 10, the holding surface 8*a* of the holding portions 8, 8, and the abutment surfaces 2*b*, 2*b* of the roll abutment portions 2A, 2A hold cooperatively the roll staple 20 so as to be rotatable striding the binding band 21 of the roll staple 20. By the arrangement of this, the exposed adhesive surface 23A of the adhesive tape 23 would not contact with the inner surface 2*a* of the lid 2 or other surfaces as shown in FIG. 5.

Figure 4:
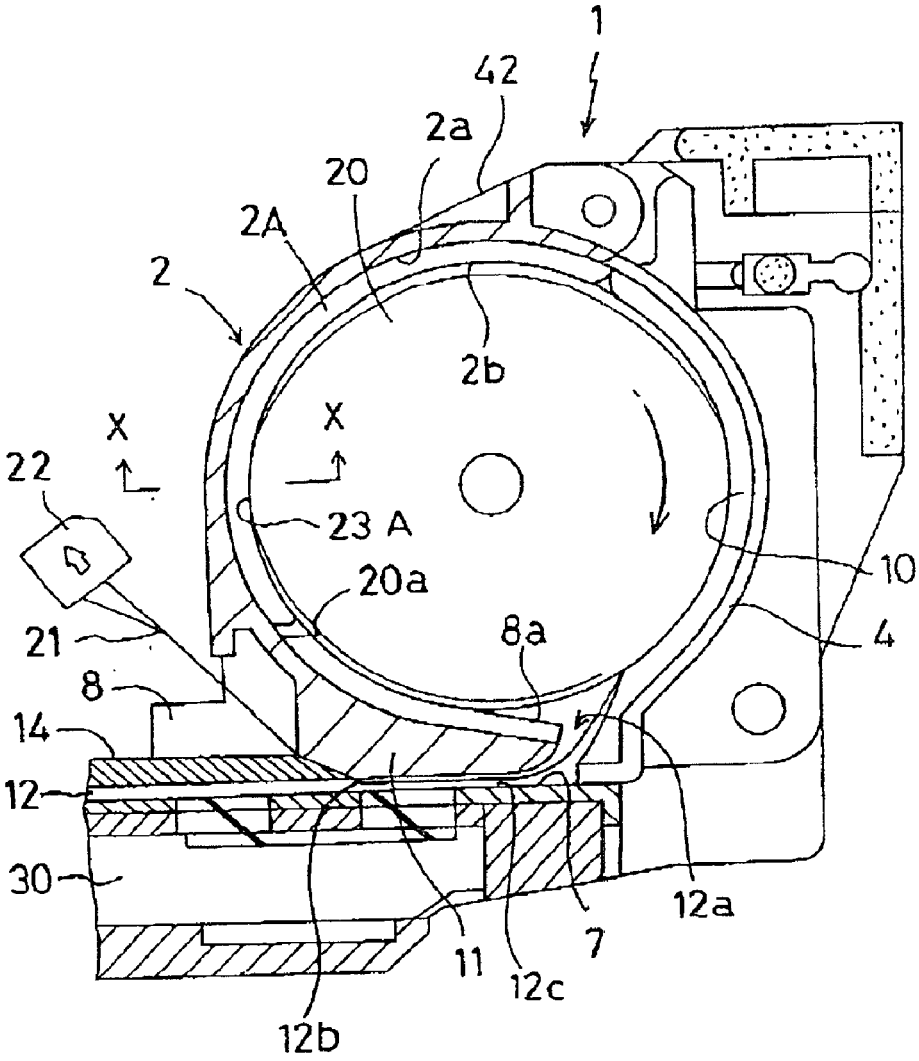
FIG. 4 is a schematic side view of the staple cartridge of FIG. 2 in a state that a roll staple is loaded on the staple cartridge.

When the tab portion 22 is pulled out further on, the roll staple 20 is made to turn according as the pulling out in the loading room 6 in the direction designated with the arrow shown in FIG. 4. At this moment the roll staple 20 turns around on so that the adhesive surface 23A of the adhesive tape 23 would not contact with the inner surfaces of the loading room 6 because the holding surface 8*a*, 8*a* and the abutment surfaces 10*a*, 10*a* and 2*b*, 2*b* contact with the outer surface of the roll staple 20 striding the binding band 21.

After the roll staple 20 turns in almost one round along the inner surface of the loading room 6, the leading end 20*a* of the roll staple 20 is lead from guide hole 12*a* through the guide carrying path 12*b* to the guide path 12 in accordance with the pulling out of the tab portion 22.

Herein, the leading end portion 20*a* of the roll staple 20 which has been lead through the guide table 7, collides with a trailing end of the staples remaining in the guide path 12 and the forward movement of it, has been stopped.

At this moment as the tab portion 22 is strongly pulled out, the binding band 21 and the adhesive tape 23 are peeled off from the leading end portion 20*a* of the roll staple 20 and pulled out, the loading of roll staple 20 has been completed. When in a case that any of staples has not remained in the guide path 12, the leading end portion 20*a* is carried and set at a predetermined operating point in the guide path 12.

Rotation of the roll staple 20 is not disturbed by the adhesive surface 23A of the adhesive tape 23 during these series of steps for the tab portion 22 to be pulled out. By this arrangement, pulling out of the tab portion 22 does not require much force because a pulling out force, which is required to pull out the tab portion 22, is only a force which is required enough to peel off the adhesive tape 23 from the roll staple 20. Moreover, it never happen that the tab portion 22 is damaged and cannot be pulled out, or that the leading end portion 20*a* collides against the guide path 12 because of too much pulling out force. By these, troubles that may happen in the loading process of the roll staple 20, are substantially dissolved.

In the above described embodiment, the binding band 21 is peelably adhered by the adhesive tape 23 onto the leading end portion 20*a* of the roll staple 20, however, it may be utilized that an adhesive material is painted on the outer surface near the trailing end of the binding band 21 to form a adhesive surface, then a part of the adhesive surface is adhered peelably onto the leading end portion 20*a* of the roll staple 20 and at the same time the binding band 21 is wound one round around the roll staple 20 and a leading end portion of the binding band 21 is adhered peelably onto the remaining portion of the adhesive surface.

Figure 12:
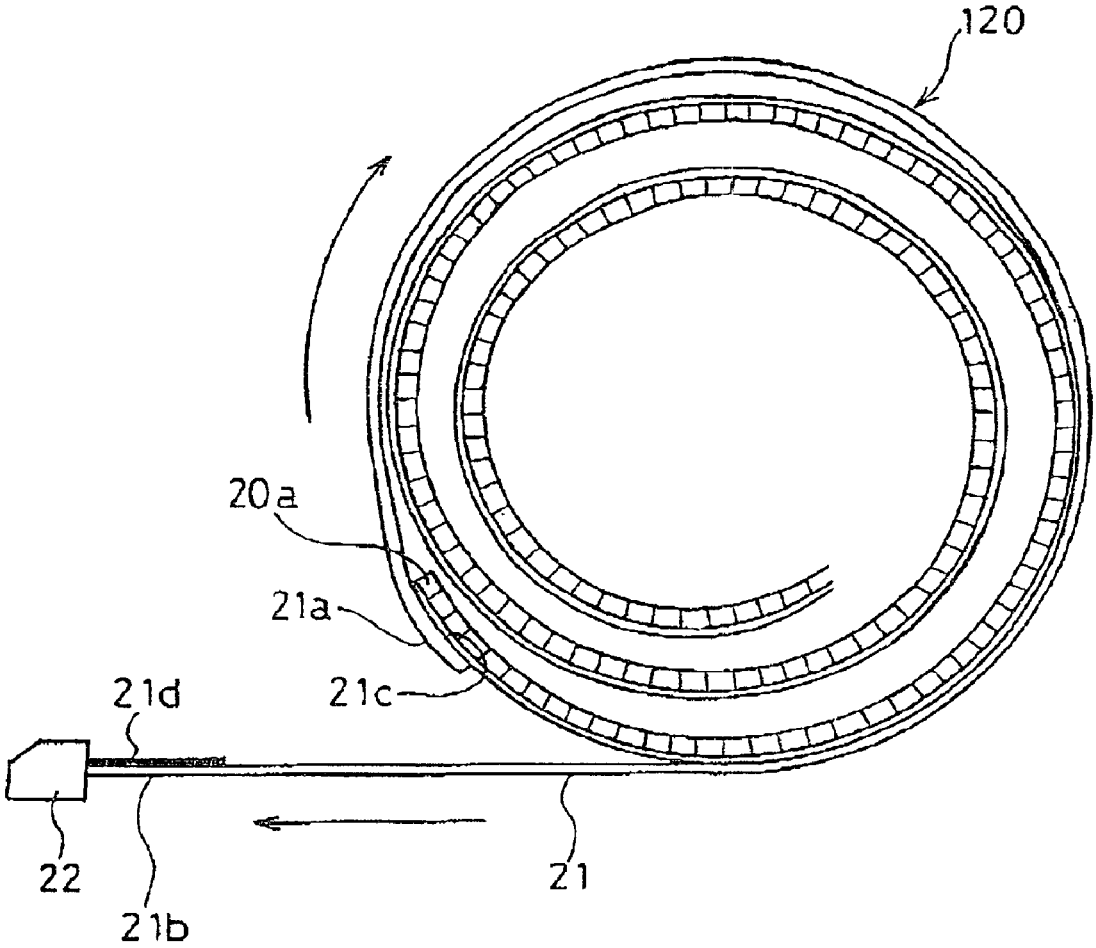
FIG. 12 is an explanatory view showing another roll staple.

FIG. 12 shows another roll staple 120, and in this roll staple 120 the adhesive surface 21*c* is formed at an inner surface of the trailing end portion 21*a* of the binding band 21, then the leading end portion 20*a* of the roll staple 120 is arranged to be adhered onto this adhesive surface, moreover another adhesive surface 21*d* is formed at an inner surface of the leading end portion 21*b* of the binding band 21, finally the adhesive surface 21*c* is arranged to adhere onto an outer surface of the trailing end portion 21*a* of the binding band 21.

The roll staple 120 is loaded onto the staple cartridge 1 in the same manner as described above, in this roll staple the outer surface of the binding band 21 does not contact with the inner surface of the loading room 6 when the binding band 21 is pulled out from the roll staple. By this arrangement the pulling out of the binding band 21 can be smoothly achieved.

[Modification 1 of the Embodiment]

In the above described embodiment, the abutment portions 10, 10 is arranged as a thicker portions which is made in one body with the lid 2 or the back wall 4, however, they are not limited to the thicker portions as far as the step structure has been made.

For example, the abutment portions 10, 10 and 2A, 2A may be formed by strips of film or sheet adhered onto the inner surfaces 2*a* of the lid 2 and the inner surface of back wall 4 with much wider spacing than the width of the binding band 21. Herein it shows enough effect when the thickness of this film is about 0.2 mm, however, the thickness may be much thicker.

[Modification 2 of the Embodiment]

It is preferable that material which has low frictional resistance is selected as these film or sheet for the modification 1. By this selection the rotation of the roll staple 20 can be smoothly performed even when the outer surface of roll staple 20 gets into contact with such film or sheet because the frictional resistance is low. As an example of this material, a film made of Teflon can be brought up.

What is claimed is:

1. A roll staple cartridge used to load a roll staple, said roll staple cartridge comprising:

a cartridge body having a loading room to load a roll staple; and a lid provided for opening and closing an opening hole formed in said cartridge body to load said roll staple;

said roll staple including a sheet staple being formed in a roll shape and having a large number of straight staples in parallel, and a band adhered peelably through an adhering tape to an outer surface of the sheet staple, said adhering tape being structured so that its outer surface is an adhesive surface, said cartridge body being provided with a punching out portion from which a staple is punched out and a pair of supporting portions supporting said roll staple, a pair of roll abutment portions being formed on an inner surface of said loading room to support rotatably said roll staple and the pair of roll abutment portions in the loading room being arranged with a larger space than a width of said adhesive surface of the band, and a smaller space than a width of said sheet staple, to prevent the adhesive surface from contacting with the inner surface of said loading room.

2. The roll staple cartridge used to load a roll staple according to claim 1, wherein said roll abutment portions are made of thicker portions which are made in one body with said loading room and arranged symmetrically in right and left on the inner surface of said loading room with spacing.

3. The roll staple cartridge used to load a roll staple according to claim 1, wherein an inner surface of the lid is formed in circular shape, a pair of roll abutment portions is formed along the inner surface of the lid, to support rotatably said roll staple, and said roll abutment portions are made of thicker portions which are made in one body with said lid and arranged symmetrically in right and left on the inner surface of said lid with spacing.

4. The roll staple cartridge used to load a roll staple according to claim 1, wherein a roll abutment surfaces of said roll abutment portions of said staple loading room and said pair of roll abutment portions of said lid are covered with a low frictional surface material.

5. A roll staple and roll staple cartridge comprising:

a roll staple; and a cartridge body having a loading room to load said roll staple and a lid provided for opening and closing an opening hole formed in said cartridge body to load said roll staple;

said roll staple being formed by winding a sheet staple and a binding band in a roll shape, said sheet staple being formed by adhering a large number of straight staples in parallel, said band being adhered peelably through an adhering tape to the sheet staple, said adhering tape being set so that its outer surface is an adhesive surface;

said cartridge body being provided with a punching out portion from which a staple is punched out and a pair of supporting portions which support said roll staple, a pair of roll abutment portions being formed on an inner surface of said loading room to support rotatably said roll staple, the pair of roll abutment portions in the loading room being arranged with a larger space than the width of the band wound around the outer surface of said roll staple and said adhesive surface, and a smaller space than the width of said sheet staple, to prevent the adhesive surface from contacting with the inner surface of said loading room.

6. The roll staple and roll staple cartridge according to claim 5, wherein said roll abutment portions are made of thicker portions which are made in one body with said loading room and arranged symmetrically in right and left on the inner surface of said loading room with spacing.

7. The roll staple and roll staple cartridge according to claim 5, wherein an inner surface of the lid is formed in circular shape, a pair of roll abutment portions is formed along the inner surface of the lid, to support rotatably said roll staple, and said roll abutment portions are made of thicker portions which are made in one body with said lid and arranged symmetrically in right and left on the inner surface of said lid with spacing.

8. The roll staple and roll staple cartridge according to claim 5, wherein roll abutment surfaces of said roll abutment portions of said staple loading room and said pair of roll abutment portions of said lid are covered with low frictional surface material.

* * * * *